US007943563B2

(12) United States Patent
Schlosser

(10) Patent No.: US 7,943,563 B2
(45) **Date of Patent: *May 17, 2011**

(54) METHOD OF CLEANING FIREARMS AND ORDNANCE

(75) Inventor: Ted M. Schlosser, Tamaqua, PA (US)

(73) Assignee: Bulk Chemicals, Inc., Reading, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/728,779

(22) Filed: Mar. 22, 2010

(65) Prior Publication Data

US 2010/0170532 A1 Jul. 8, 2010

Related U.S. Application Data

(60) Continuation of application No. 11/974,704, filed on Oct. 15, 2007, which is a division of application No. 10/652,178, filed on Aug. 29, 2003, now abandoned.

(51) Int. Cl.
*C11D 1/722* (2006.01)
*C11D 3/30* (2006.01)
*C11D 3/36* (2006.01)

(52) U.S. Cl. ..... 510/190; 510/245; 510/254; 510/264; 510/499; 510/505; 510/506; 134/41; 134/42

(58) Field of Classification Search ..... 510/190, 510/245, 254, 264, 499, 505, 506; 134/41, 134/42

See application file for complete search history.

(56) References Cited

U.S. PATENT DOCUMENTS

| | | | | |
|---|---|---|---|---|
| 3,607,769 | A | 9/1971 | Page | |
| 3,854,996 | A | 12/1974 | Frost et al. | |
| 3,996,062 | A | 12/1976 | Frost et al. | |
| 4,666,528 | A | 5/1987 | Arrington et al. | |
| 4,784,789 | A | 11/1988 | Jeschke et al. | |
| 4,806,274 | A | 2/1989 | Crouse et al. | |
| 4,869,827 | A | 9/1989 | Chagnard et al. | |
| 5,306,336 | A | 4/1994 | Martyak et al. | |
| 5,714,448 | A * | 2/1998 | Choy et al. | 510/181 |
| 5,858,245 | A | 1/1999 | Gallup | |
| 5,906,973 | A * | 5/1999 | Ouzounis et al. | 510/503 |
| 6,153,571 | A * | 11/2000 | Komocki et al. | 510/190 |
| 6,173,776 | B1 | 1/2001 | Furman et al. | |
| 6,239,093 | B1 | 5/2001 | Foley et al. | |
| 6,277,801 | B1 | 8/2001 | Dahanayake et al. | |
| 6,458,517 | B2 | 10/2002 | Nohara et al. | |
| 6,462,010 | B1 * | 10/2002 | Aszman et al. | 510/417 |
| 6,475,966 | B1 | 11/2002 | Sahbari | |
| 6,541,434 | B2 | 4/2003 | Wang | |
| 6,596,093 | B2 | 7/2003 | DeYoung et al. | |
| 6,815,150 | B2 | 11/2004 | Nakahara et al. | |
| 2002/0037819 | A1 | 3/2002 | Sahbari | |
| 2002/0077259 | A1 | 6/2002 | Skee | |
| 2003/0104961 | A1 | 6/2003 | Lentsch et al. | |
| 2003/0109403 | A1 | 6/2003 | Man et al. | |
| 2003/0138737 | A1 | 7/2003 | Wakiya et al. | |
| 2003/0158078 | A1 | 8/2003 | Chang | |
| 2004/0009883 | A1 | 1/2004 | Ikemoto et al. | |
| 2004/0081922 | A1 | 4/2004 | Ikemoto et al. | |
| 2005/0043205 | A1 | 2/2005 | Bettiol et al. | |
| 2006/0058211 | A1 * | 3/2006 | Aihara et al. | 510/499 |

FOREIGN PATENT DOCUMENTS

| | | | |
|---|---|---|---|
| WO | WO 0071658 | | 11/2000 |
| WO | WO03/070867 | * | 8/2003 |

* cited by examiner

*Primary Examiner* — Gregory R Del Cotto
(74) *Attorney, Agent, or Firm* — RatnerPrestia

(57) ABSTRACT

A method of removing metallic copper from a steel surface defining a bore or cylinder of a gun is provided. The method involves contacting the surface with a composition comprising a polyphosphonic acid, a hydroxyl-substituted primary amine, and water.

21 Claims, No Drawings

METHOD OF CLEANING FIREARMS AND ORDNANCE

CROSS REFERENCE TO RELATED APPLICATIONS

This application is a Continuation of U.S. application Ser. No. 11/974,704, filed Oct. 15, 2007, which is a Division of U.S. application Ser. No. 10/652,178, filed Aug. 29, 2003, the entire specifications of which are incorporated herein by reference.

FIELD OF THE INVENTION

The invention relates to compositions and methods for removing copper from a surface. More particularly, it relates to removing copper residue from the barrel of a gun.

BACKGROUND OF THE INVENTION

When firearms, such as pistols, rifles and the like are fired, small amounts of residues deposit within the bore, that is, inside the barrel. This buildup is in fact a problem in nearly all kinds of guns, including very large bore armaments such as artillery pieces. The residues may include grease and other lubricants from bullets or cartridges, carbon from the burning of the propellant, and metallic deposits from the bullet. One particularly troublesome metallic deposit is copper, which is produced when copper-clad or brass-clad rounds of ammunition are fired. Over a period of time, copper and other deposits build up and adversely affect the efficiency and utility of the firearm. As a result, the firearm must be periodically cleaned to maintain maximum accuracy, efficiency, utility and useful operating life.

The standard method of cleaning a firearm includes the use of a patch of fabric cloth or a swab, attached to a cleaning rod. A large amount of copper buildup on the firearm typically requires some scraping with a sharp instrument to take off the bulk of the copper, prior to using the cleaning rod. The cloth or swab is then impregnated with cleaning solution, and the cleaning rod is run back and forth through the barrel (bore). Typical cleaning solutions include strong solvents and/or ammonia, which break down the various residues. The cloth or swab is frequently replaced so as not to transfer residues from one part of the firearm to another. A brass brush is typically connected to the cleaning rod and inserted vigorously through the barrel and the cylinders to loosen and clean the metal and/or carbon residue on the components of the firearm. After using the brush, clean cloths or swabs are subsequently run through the barrel and the cylinders to remove any remaining cleaning solution and/or residue in the firearm. A protective oil is typically applied to the firearm components after cleaning, as a rust preventative.

This multi-step cleaning method is time-consuming and messy, and thus there is a tendency among firearms users to perform this task somewhat less frequently than would be desirable. For example, in the case of a small firearm such as a rifle, even an hour spent on cleaning will frequently not leave the weapon completely free of carbon and/or metal residues, especially copper. The result is incomplete cleaning, resulting in deterioration in firearm performance. Similar problems exist for larger armaments, such as artillery.

Although typical cleaners satisfactorily remove some of the residues in firearms, they frequently suffer from certain disadvantages. For example, many cleaners are of low effectiveness in removing copper deposits. Some cleaners have a deleterious effect on the metal parts of the firearm (e.g. etching or embrittlement of the metal) which can adversely effect the accuracy of the firearm and/or cause the firearm to become unsafe or unreliable to use.

Many commonly used cleaners include highly volatile components which are flammable and/or have relatively low flash points, thus requiring special care during use. Many cleaners comprise solvents that are highly toxic and require special care, including the use of ventilated environments and the wearing of gloves and/or other handling equipment during firearm cleaning. Some cleaners include abrasives and/or require the addition of abrasives during the cleaning process, with the attendant possibility of scratching and/or damaging the firearm. Thus, commonly used cleaners can be inconvenient to use, store and/or handle, and can be very time-consuming to use.

There is a continued need for compositions and methods of cleaning gun bores employing means that are effective in removing copper and other deposits, without the need to resort to the use of flammable organic solvents or ammonia.

SUMMARY OF THE INVENTION

In one aspect, the invention is a composition for removing copper from a surface, the composition comprising between 0.5 wt. % and 15.0 wt. % of a polyphosphonic acid, between 1.0 wt. % and 40.0 wt. % of a hydroxyl-substituted primary amine, and water, and having a pH between 9.0 and 12.5.

In another aspect, the invention is a composition for removing copper from a surface, the composition comprising a polyphosphonic acid, a hydroxyl-substituted secondary amine, a surfactant, and water, and having a pH between 9.0 and 12.5.

In yet another aspect, the invention is a composition for removing copper from a surface, the composition comprising a polyphosphonic acid, an amino acid, a surfactant, and water, and having a pH between 9.0 and 12.5.

In a further aspect, the invention is a composition for removing copper from a surface, the composition comprising a polyphosphonic acid, a compound comprising a nitrogen-containing heteroaromatic ring, a surfactant, and water, and having a pH between 9.0 and 12.5.

In a still further aspect, the invention is a method of removing copper from a surface, the method comprising contacting the surface with a composition comprising a polyphosphonic acid, a primary amine, and water to effect a removal of the copper.

In yet a further aspect, the invention is a method of cleaning a gun bore, the method comprising contacting the bore with a composition comprising a polyphosphonic acid, a primary amine, and water.

DETAILED DESCRIPTION OF THE INVENTION

The invention provides compositions and methods for removing copper from a surface. It will be understood that, as used herein, reference to removal of copper from a surface includes removal of brass from a surface. In one embodiment, the surface comprises a metal, with steel being one nonlimiting example. In one particular embodiment, the compositions of this invention are used to remove copper from the surface of high-grade steels, such as for example stainless steel 300 and 400 series, 4140 series and other chromium-molybdenum ordnance grade alloys. In another particular embodiment, the invention provides compositions and methods for removing copper deposits from gun bores, and/or cylinders, such as in a revolver. The compositions do this without using ammonia, which produces an irritating odor in compositions that employ it, and without the use of petroleum solvents.

Compositions according to the invention comprise a polyphosphonic acid, an amine, and water. The water is typically deionized. The compositions may also comprise other ingredients useful for removing other surface contaminants, for example carbon deposits and/or grease, from the treated surface. It will be understood that, once incorporated into the composition, the polyphosphonic acid and the amine may to a great extent be in the form of salts. This may be true for other ingredients as well. Thus, for simplicity, compositions recited herein are recited on the basis of the unreacted components as named, even though they may to some extent have changed form in the final composition.

Polyphosphonic Acid

The term "polyphosphonic acid", as used herein, means a compound comprising two or more phosphonic acid moieties per molecule. A wide variety of polyphosphonic acids is suitable for use according to the invention. In one exemplary embodiment, the polyphosphonic acid comprises a polymethylenephosphonic acid according to formula I $$(HO)_2P(O)CH_2—R^1—CH_2(O)P(OH)_2 \quad \text{I}$$

wherein $R^1$ is a divalent organic radical which may comprise additional phosphonic acid groups. In one embodiment of the invention, $R^1$ may comprise a structure according to formula II $$—NR^3—R^2—NR^4— \quad \text{II}$$

wherein $R^2$ is a divalent organic radical which may comprise additional phosphonic acid groups, and $R^3$ and $R^4$ are each separately hydrogen or an alkyl group having from one to twenty carbon atoms.

Suitable polyphosphonic acids for use according to the invention may include for example polymethylenephosphonic acids. One exemplary group of such materials comprises compounds with an ethylenediamine or polyethylenediamine backbone, and having a structure according to formula III $$R^5—(—NR^6—CH_2—CH_2—)_n—NR^7R^8 \quad \text{III}$$

wherein n is an integer from 1 to 10, and each of $R^5$, $R^6$, $R^7$, and $R^8$ is independently hydrogen, a hydrocarbyl group having from one to twenty carbon atoms, and a phosphonomethyl group, provided that at least two of $R^5$, $R^6$, $R^7$, and $R^8$ are phosphonomethyl groups. In one exemplary group of polyphosphonic acids according to the invention, n is from 2 to 5 and all of $R^5$, $R^6$, $R^7$, and $R^8$ are phosphonomethyl groups. Examples of such compounds include ethylenediaminetetramethylenephosphonic acid and diethylenetriaminepentamethylenephosphonic acid (DTPMP). DTPMP is available from Solutia of St. Louis, Mo.

Other suitable examples of polyphosphonic acids for use according to the invention include polyethylenediamines wherein two or more nitrogen atoms in the backbone each bear at least one phosphonomethyl moiety substituted thereon, and/or wherein the polyphosphonic acid comprises at least one nitrogen atom bearing at least two phosphonomethyl moieties substituted thereon. Further suitable examples of polyphosphonic acids include 1-hydroxyethane-1,1-diphosphonic acid, aminotrimethylenephosphonic acid, hexamethylenediaminetetramethylenephosphonic acid, 2-hydroxyethyliminobis(methylenephosphonic acid), and bis(hexamethylene)triaminepentamethylenephosphonic acid. Although a number of exemplary polyphosphonic acids are recited above to illustrate the variety of polyphosphonic acids that may be suitable for use according to the invention, any polyphosphonic acid may be used. It will be understood that mixtures of polyphosphonic acids may also be used in accordance with the invention. The polyphosphonic acid, or mixture of acids, typically constitutes at least 0.5 wt. % of the composition, preferably at least 2.0 wt. %, and more preferably at least 3.5 wt. %. It typically constitutes at most 15.0 wt. % of the composition, preferably at most 8.0 wt. %, and more preferably at most 6.0 wt. %. However, amounts of polyphosphonic acid outside of these ranges may also be used.

Amine

Compositions according to the invention also comprise an amine, which may be a primary amine, a secondary amine, and/or a compound comprising a nitrogen-containing heteroaromatic ring such as a substituted or unsubstituted pyridine, pyrimidine, triazine, pyrrole, bipyridine, ring-substituted derivative of these, and/or ring-fused derivative of these, such as for example substituted or unsubstituted benzimidazole and substituted or unsubstituted benzoxazole.

Typically the amine comprises a primary amine. In one exemplary embodiment of the invention, suitable primary amines may include alkylamines wherein the alkyl substituent comprises from five to twenty carbon atoms. In another exemplary embodiment, the primary amine comprises a hydroxyl-substituted primary amine, including as nonlimiting examples vicinal alkanolamines such as ethanolamine and isopropanolamine. Other suitable primary amines may include polyamines. One exemplary group of suitable polyamines includes ethylenediamine and polyethylenediamines, such as for example diethylenetriamine, triethylenetetramine, tetraethylenepentamine, pentaethylenexhexamine, and higher homologs. Terminal diamines such as hexamethylenediamine and tetramethylenediamine may also be used, as may homologs of diethylenetriamine such as bis(hexamethylene)triamine.

Amino acids may also be used according to the invention, to provide the amine. In certain cases, for example where the amine is an amino acid or a hydroxyl-substituted amine or a polyethylene diamine, the composition may have a very low odor. Although a number of exemplary amines are recited above to illustrate the variety of amines that may be suitable for use according to the invention, any amine may be used. It will also be noted that mixtures of amines may also be used in accordance with the invention, and may comprise any combination of primary, secondary, and tertiary amines. Further, it will be understood that amines suitable for use according to the invention may comprise a combination of primary, secondary, and/or tertiary amine functionality in a single molecule.

In one embodiment of the invention, the composition may comprise a dialkanolamine and/or a trialkanolamine, either alone or in combination with another amine, for example a primary amine. If a combination of primary amine with a dialkanolamine and/or a trialkanolamine is used, the primary, secondary, and/or tertiary amine groups may or may not be in the same molecule. In one particular embodiment, the other amine comprises an alkanolamine such as ethanolamine. Nonlimiting examples of suitable dialkanolamines and trialkanolamines include diethanolamine, diisopropanolamine, and triethanolamine. The use of such a component may, inter alia, allow for more facile adjustment of the pH of the composition, which may be beneficial to its activity in removing copper and/or other residues from the surface being treated.

Without wishing to be bound by any particular theory or explanation, it is believed that the amine complexes copper species, facilitating removal of copper from the surface being treated. The amine, or mixture of amines, typically constitutes at least 1 wt. % of the composition, preferably at least 10 wt. %, and more preferably at least 18 wt. %. It typically constitutes at most 40 wt. % of the composition, preferably at most 30 wt. %, and more preferably at most 20 wt. %. However, amounts outside of these ranges may also be used.

In the case where the amine comprises a mixture of amines, of which a dialkanolamine and/or trialkanolamine is a portion, the dialkanolamine(s) and/or trialkanolamine(s) may together constitute at least 0.5 wt. % of the total amine in the composition, preferably at least 1.0 wt. %, and more preferably at least 2.8 wt. %. They may constitute at most 9.0 wt. % of the amine in the composition, preferably at most 6.0 wt. %, and more preferably at most 3.2 wt. %. One exemplary embodiment of a composition comprising a combination of amines is as follows, with the amounts given on a parts by weight basis.

| | |
|---|---|
| Deionized Water | 55.00 |
| Monoethanolamine | 18.00 |
| Triethanolamine | 0.28 |
| Propylene Glycol | 18.50 |
| Diethylenetriaminepentamethylenephosphonic acid | 3.22 |
| Ethoxylated propylated fatty alcohol | 4.00 |
| Amine carboxylate | 1.00 |

Degreaser

Compositions according to the invention may optionally comprise a degreaser, which may for example be useful in formulations for cleaning gun barrels (bores) that have lubricants and and/or other oily or hydrophobic contaminants in them. Nonlimiting examples of degreasers suitable for use according to the invention are ethylene glycol monobutyl ether, diethylene glycol monobutyl ether, and glycol dialkyl ethers derived from mono- or di-ethylene glycol or from mono- or di-propylene glycol. Other suitable degreasers include polyglycols, for example polyethylene glycols and polypropylene glycols. Methyl glycine may also be used. In one exemplary embodiment, the degreaser comprises propylene glycol alone.

It will be understood that mixtures of degreasers may also be used in accordance with the invention. The degreaser, or mixture of degreasers, may constitute at least 1 wt. % of the composition, preferably at least 10 wt. %, and more preferably at least 18 wt. %. It may constitute at most 65 wt. % of the composition, preferably at most 40 wt. %, and more preferably at most 19 wt. %.

Surfactant

Compositions according to the invention may optionally comprise a surfactant, which may for example be useful in formulations for cleaning gun barrels (bores) that have carbon deposits or other contaminants in them. Suitable surfactants may be cationic, anionic, nonionic, or a combination of any of these. Many suitable surfactants are known in the art and are widely available commercially. Nonlimiting examples of surfactants suitable for use according to the invention include the following.

Exemplary anionic surfactants suitable for use according to the invention include carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, salts of linear alkyl benzenesulfonates, sodium lauryl ether sulfate, and fatty alcohol sulfates.

Suitable exemplary cationic surfactants include quaternary ammonium salts, for example alkylquaternary ammonium chloride surfactants such as n-alkyl ($C_{12}$-$C_{18}$) dimethylbenzylammonium chloride, n-tetradecyldimethylbenzylammonium chloride monohydrate, a naphthalene-substituted quaternary ammonium chloride such as dimethyl-1-naphthylmethylammonium chloride, and the like.

Exemplary nonionic surfactants suitable for use according to the invention include those having a polyalkylene oxide polymer as a portion of the surfactant molecule. Such nonionic surfactants include, for example, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; alkylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; ethoxylated alcohols, ethoxylated amines, and polyalkylene oxide block copolymers including an ethylene oxide/propylene oxide block copolymers. Silicone surfactants may also be used. One particular nonionic surfactant suitable for use is Rhodaclean™ ASP (ethoxylated propylated fatty alcohol), available from Ashland Distribution Company of Covington, Ky. or from Rhodia Inc., Cranbury, N.J.

It will be understood that mixtures of surfactants may also be used in accordance with the invention. The surfactant, or mixture of surfactants, may constitute at least 0.1 wt. % of the composition, preferably at least 1.0 wt. %, and more preferably at least 3.7 wt. %. It may constitute at most 15.0 wt. % of the composition, preferably at most 7.0 wt. %, and more preferably at most 4.3 wt. %.

Other Ingredients

The composition may comprise other ingredients for improving various performance aspects in certain use applications. For example, the composition may contain a rust inhibitor, if the surface to be treated comprises iron or steel. An exemplary rust inhibitor is an amine carboxylate sold under the name Thorcor CI-20 by Thornley Company Incorporated, Wilmington, Del. Still other ingredients may be added to suit particular application needs.

In one exemplary embodiment, compositions according to the invention may comprise a combination of ingredients falling within the ranges shown in the following table, where "lower" and "upper" refer to weight percent in the total formulation.

| INGREDIENT | Lower | Upper |
|---|---|---|
| Water | 5.0 | 85.0 |
| Diethylenetriaminepentamethylenephosphonic acid | 0.5 | 15.0 |
| Ethanolamine | 1.0 | 25.0 |
| Propylene Glycol | 1.0 | 65.0 |
| Ethoxylated Propylated Fatty Alcohol | 0.1 | 15.0 |
| Amine Carboxylate | 0.1 | 5.0 |

Compositions according to the invention may in general be prepared by mixing the ingredients in any sequence.

Compositions according to the invention have a pH of at least 9.0, preferably at least 11.0, and at most 12.5, preferably at most 11.5. It will be appreciated that a wide variety of combinations of the ingredients outlined above is possible according to the invention, and that adjustment of pH to the desired range may or may not be needed in order to fall within acceptable limits, depending upon the exact formulation used. If necessary, pH may be adjusted upward by addition of monoethanolamine, and may be adjusted downward by the addition of diethylenetriaminepentamethylenephosphonic acid.

Use of the compositions of this invention to remove copper from a surface is typically performed by contacting the surface to be cleaned with the composition at ambient temperature, although higher or lower temperatures may be used. The contacting may be by any of a variety of means, for example by application with a brush, roller, sprayer, or impregnated cloth or the like, or by dipping the article to be treated into the composition. The composition is typically allowed to contact the surface for a period of time, that period being dependent on the exact surface being treated, the temperature, the nature and amount of copper and other residues or contaminants on the surface, and other variables. Most commonly, the composition is then removed from the surface, although this need not always be done. If it is removed, it may be done by any commonly practiced means such as rinsing, wiping with a cloth, or the like.

In the case where the surface being treated is that of a gun bore, a contact time between 30 seconds and 5 minutes is typical, particularly if the composition comprises a primary amine. For cleaning a gun bore, standard methods of application of the composition are suitable. This may typically comprise using a patch of fabric cloth or a swab, impregnated with the composition and attached to a cleaning rod. The cleaning rod is run back and forth through the barrel (bore). A brass brush may also be used, but is typically not needed. After using composition and optionally the brush, clean cloths or swabs are typically run through the barrel and the cylinders to remove any remaining cleaning solution and/or residue in the firearm. A protective oil is typically applied to the firearm components after cleaning, as a rust preventative, but this is optional.

EXAMPLES

The effects of using a combination of a primary amine and polyphosphonic acid were investigated by mass loss experiments on copper metal coupons. Three formulations were tested at room temperature by immersing weighed copper panels in each formulation for four minutes, rinsing with deionized water, drying in an oven for 15 minutes, allowing to cool to room temperature, and reweighing to determine the mass lost. An etch rate for each formulation was then calculated based on the 0.052 square foot area of each coupon. The formulation amounts are given in wt. %. The ethoxylated propylated fatty alcohol was Rhodaclean™ ASP, and the amine carboxylate was Thorcor CI-20.

| INGREDIENT | 1 | 2 | 3 |
|---|---|---|---|
| Water | 58.5 | 73.0 | 55.0 |
| Diethylenetriaminepenta-methylenephosphonic acid | | 3.22 | 3.22 |
| Ethanolamine | 18.0 | | 18.0 |
| Triethanolamine | | 0.28 | 0.28 |

-continued

| INGREDIENT | 1 | 2 | 3 |
|---|---|---|---|
| Propylene Glycol | 18.5 | 18.5 | 18.5 |
| Ethoxylated Propylated Fatty Alcohol | 4.0 | 4.0 | 4.0 |
| Amine Carboxylate | 1.0 | | 1.0 |
| Coupon Mass (grams, before etch) | 9.4283 | 10.0931 | 10.2815 |
| Coupon Mass (grams, after etch) | 9.4282 | 10.0925 | 10.2782 |
| Copper Mass Lost (grams) | 0.0001 | 0.0006 | 0.0033 |
| Copper Etch Rate (mg/ft$^2$/min) | 0.48 | 2.87 | 15.75 |

The data indicate that the combination of a primary amine with DTPMP offers a vastly increased etch rate on copper metal compared with either constituent alone. This property is of great importance when used to clean ordnance of copper or brass residues in a timely manner.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method of removing metallic copper from a steel surface, the method comprising contacting the steel surface with a composition comprising a polyphosphonic acid, ethanolamine and water for a period of time sufficient to remove the metallic copper, wherein the steel surface defines a bore or cylinder of a gun, wherein the composition comprises between 0.5 wt. % and 15.0 wt. % of the polyphosphonic acid, between 1.0 wt % and 40.0 wt. % of said ethanolamine, and has a pH between 9.0 and 12.5.

2. The method of claim 1, wherein the contacting is performed at ambient temperature.

3. The method of claim 1, the composition further comprising at least one of a dialkanolamine and a trialkanolamine.

4. The method of claim 3, wherein said at least one of a dialkanolamine and a trialkanolamine comprises triethanolamine.

5. The method of claim 1, wherein the polyphosphonic acid comprises a polymethylenephosphonic acid.

6. The method of claim 1, wherein the polyphosphonic acid has a polyethylenediamine backbone and wherein two or more nitrogen atoms in the backbone each bear at least one phosphonomethyl moiety substituted thereon.

7. The method of claim 1, wherein the polyphosphonic acid comprises diethylenetriaminepentamethylenephosphonic acid.

8. The method of claim 1, wherein the polyphosphonic acid comprises at least one nitrogen atom bearing at least two phosphonomethyl moieties substituted thereon.

9. The method of claim 1, wherein the composition further comprises a degreaser.

10. The method of claim 9, wherein the degreaser comprises a polyglycol.

11. The method of claim 9, wherein the degreaser comprises polypropylene glycol.

12. The method of claim 9, wherein the degreaser comprises at least one of propylene glycol and polypropylene glycol.

13. The method of claim 9, wherein the degreaser comprises at least one dialkyl ether of a glycol selected from the group consisting of ethylene glycol, diethylene glycol, propylene glycol, and dipropylene glycol.

14. The method of claim 1, wherein the composition further comprises a surfactant.

15. The method of claim 14, wherein the surfactant comprises an ethoxylated propylated fatty alcohol.

16. The method of claim 1, wherein the composition has a pH between 11.0 and 11.5.

17. The method of claim 1, wherein the polyphosphonic acid comprises diethylenetriaminepentamethylenephosphonic acid and the composition further comprises a surfactant.

18. The method of claim 1, wherein the steel surface defines said gun bore and the contacting comprises impregnating a fabric cloth or swab with the composition, attaching the cloth or swab to a rod, and running the rod back and forth through the gun bore.

19. The method of claim 1, wherein the composition further comprises a rust inhibitor.

20. The method of claim 19, wherein the rust inhibitor is an amine carboxylate.

21. The method of claim 15, wherein the composition further comprises one or more additional nonionic surfactants.

* * * * *